United States Patent [19]

Krause

[11] Patent Number: 5,042,559

[45] Date of Patent: Aug. 27, 1991

[54] METHOD FOR MONITORING THE SOLIDIFICATION PROCESS DURING CONTINUOUS CASTING

[75] Inventor: Andreas Krause, Osnabrück, Fed. Rep. of Germany

[73] Assignee: KM-Kabelmetal Aktiengesellschaft, Osnabrück, Fed. Rep. of Germany

[21] Appl. No.: 482,813

[22] Filed: Feb. 21, 1990

[30] Foreign Application Priority Data

Feb. 23, 1989 [DE] Fed. Rep. of Germany ..... 3905516

[51] Int. Cl.[5] ..... B22D 11/16; B22D 27/02

[52] U.S. Cl. ..... 164/41; 164/467; 164/503; 164/150

[58] Field of Search ..... 164/467, 503, 4.1, 150; 324/204, 207.17

[56] References Cited

U.S. PATENT DOCUMENTS

| | | | |
|---|---|---|---|
| 4,414,285 | 11/1983 | Lowry et al. | 164/467 |
| 4,495,983 | 1/1985 | Kindlmann et al. | 164/503 |
| 4,796,687 | 1/1989 | Lewis et al. | 164/467 |

*Primary Examiner*—Kuang Y. Lin

*Attorney, Agent, or Firm*—Kenyon & Kenyon

[57] ABSTRACT

The trouble free operation of a continuous casting process utilizing a moving electromagnetic field for levitation requires information of sufficient accuracy concerning the position and extent of the solidification front inside the continuous casting die. The method and structure according to the invention for monitoring the solidification process employs signals from at least two sensor coils arranged concentrically around the continuous casting die. These signals are fed to a measuring transducer and processed in an appropriate manner. The configuration of the sensor coils inside the levitation coil generating the moving field is particularly preferred.

11 Claims, 2 Drawing Sheets

METHOD FOR MONITORING THE SOLIDIFICATION PROCESS DURING CONTINUOUS CASTING

BACKGROUND OF THE INVENTION

A casting process, also known as vertical continuous levitation casting, which allows metal rods to be continuously produced out of melt is disclosed in German Patent DE-A-30 49 353 (which corresponds to U.S. Pat. No. 4,414,285). An essential aspect of this casting process is that a specific section of a water cooled die or mould, and in particular, the solidifying metal column situated inside the die, is surrounded concentrically by a special induction coil, the so called levitation coil. As a rule, this levitation coil is comprised of a larger number of winding groups (e.g., 6) arranged one above another, which are coupled to one another in a way which allows an upwardly moving, alternating electromagnetic field to form within the levitation coil when the levitation coil is excited by a three phase voltage source. The magnetic field of the levitation coil induces eddy currents in the molten metal. The radial and axial components of the magnetic induction produced by the levitation coil result in the generation of forces in the axial direction (upwards) and in the radial direction on the liquid metal traversed by the flow of eddy currents or on the already solidified metal. These forces reduce the pressure of the melt and of the casting shell on the wall of the die. This effect reduces the frictional forces at the die/metal interface, thus enabling an increase of the casting speed.

SUMMARY OF THE INVENTION

For the casting process to proceed smoothly, one must be able to monitor any deviations from the nominal position of the solidification front within the continuous casting die, so that one can then react to this by modifying the casting parameters in a timely fashion.

Therefore, the object of the invention is to specify structure and method of measurement with which the position and extent of the solidification front can be simply and sufficiently accurately identified during the casting process.

This objective is attained by utilizing signals from sensor coils arranged concentrically around the continuous casting die, which are fed to a measuring transducer and then evaluated.

Essentially, the invention is based on the realization that the electrical conductivity of metals increases with the transition from a molten into a solid state, and also with decreasing temperature. For pure metals, the electrical conductivity at the solidification point rises rapidly to a value which is distinctly higher than that in the molten state. The electrical conductivity of alloys likewise shows a distinct increase within the temperature range in which the solidification of the metal alloy sets in.

With increasing height, the temperature of the melt decreases due to the progressive withdrawal of heat within the continuous casting die. Depending on the respective position attained, the portion of solidified metal also increases, until the central metal column is completely solidified. In accordance with the progressive cooling of the metal as well as the change in the phase portions during solidification, the distribution of the electrical conductivity changes specifically within the central metal column. Consequently, it is possible to assign a characteristic conductivity distribution to each cross-sectional plane of the die perpendicular to the moving direction of the strand.

As a result of the relatively high casting speed, the cooling and solidification range of the melt within the die is spread far apart. For example, in the casting of round, full sections, the length of this range amounts to several times the diameter of the strand. Accordingly, the conductivity distribution changes slowly over the length of the die. An important characteristic of the continuous levitation casting is that nearly the entire length of the die is surrounded by a levitation coil. The frequency of excitation is selected so that the penetration depth of the magnetic field has the same order of magnitude as the strand radius. This ensures that the outer area of the strand cross-section, where the solidification sets in and which is of interest for monitoring the casting process, is penetrated to a sufficient extent by the excitation field. The resulting eddy currents thereby generate a secondary field which can supply information concerning the conductivity distribution within the metal column.

DETAILED DESCRIPTION

The continuous casting die is comprised of a tubular member for example, around which a heat exchanger is arranged in a circular shape. Since the walls of the heat exchanger and of the die are relatively thin and are manufactured of materials which at high thermal conductivity weaken the magnetic field of the levitation coil a minimal amount, the secondary field is also only weakened to a small extent. The sensor coils arranged concentrically around the central column of the molten or the already solidified metal supply signals (measurement voltages) concerning the secondary field to a measuring transducer. After evaluating these signals, it is possible to make a statement concerning the position and extent of the solidification front, and to directly control the course of the solidification during the casting process. Thus, fluctuations or variations in the course of the solidification, which can be noticeable due to the increased occurrence of irregularities in the area near the surface of the strand cross section, are recognized in advance of the stage at which the strand reaches the exit area of the die.

The sensor coils are advantageously situated inside the levitation coil and outside of the continuous casting dies because the measuring signals are strongest there and hence the easiest to detect. The windings of the sensor coil then have a diameter whose size lies between the inside diameter of the levitation coil and the outside diameter of the continuous casting die. However, the sensor coils can also be arranged in the space between the levitation coil and the heat exchanger wall, or in the die casing.

Figure 2:
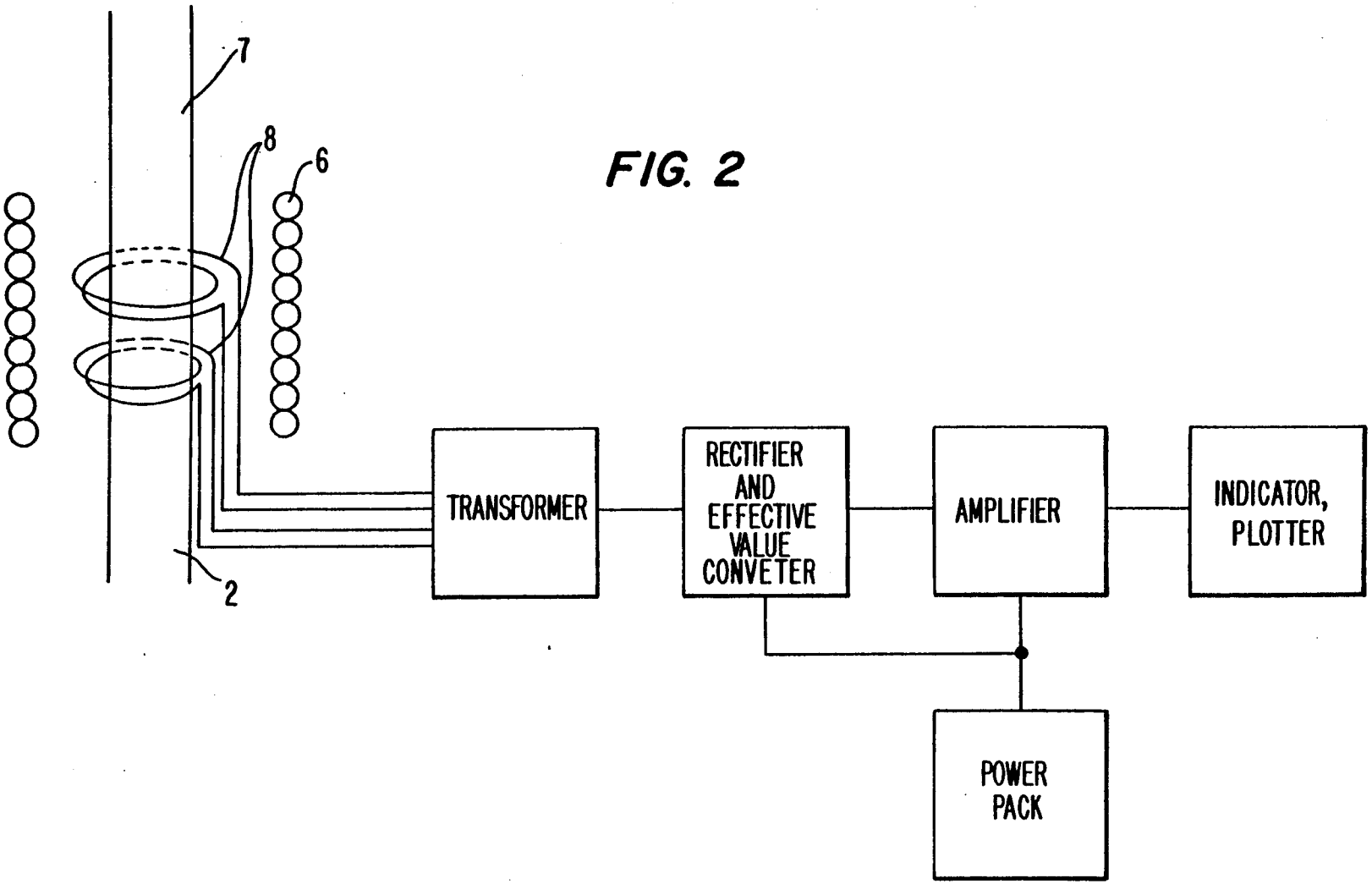
FIG. 2 shows, in block diagram form, the circuitry for processing signals from the sensor coils.

Preferably, the sensor coils consist of one or several windings of a thin, insulated wire. In a preferred specific embodiment, the wire is coiled around as tightly as possible in a spiral form in several windings on the external surface of the outer wall of the heat exchanger in one or several layers. The two wire ends of each sensor coil lead to a measuring transducer, which as shown in FIG. 2 processes the voltage signal measured at the wire ends during operation.

The voltage induced in each sensor coil by the alternating field of the levitation coil is a function of the frequency, of the amperage of the current flowing through the levitation coil, and of the conductivity distribution within the central metal column. Furthermore, the induced voltage is a function of the geometry of the sensor coils and the levitation coil, as well as of their configuration relative to one other.

As a general principle, the cooling of the liquid or solidified metal column leads to an increase in conductivity. At constant excitation field strength, this increase in conductivity is indicated by a decline in the amplitude of the measuring voltage. However, when only one sensor coil is used, the reason for the change in a measuring signal can not be clearly identified. Therefore, preferably at least two sensor coils are arranged one above another, and the respective measuring voltages supplied to the measuring transducer are contrasted with each other. The measuring voltage which corresponds to the molten state of the metal is expediently selected as a reference signal. The further cooling of the strand through temperatures above that at which the solidication is finished then leads, in the case of those temperature changes which usually occur during the casting process, only to a relatively small reduction of the voltage amplitude on one sensor coil. On the other hand, the entire development of the solidification itself is characterized by a decline in voltage amplitude which is much more perceptible. The conductivity distribution during the cooling and solidification of the melt within the continuous casting die results in a profile of measuring voltages on the sensor coils arranged one above the other, with which the position and the extent of the solidification front can be determined with sufficient accuracy. In this manner, an uneven solidification development during the casting process can be recognized immediately.

All of the disturbances in the course of solidification can be determined by the characteristic signal patterns.

An unacceptable migration of the solidification front out of the nominal position in the casting direction can be recognized by the fact that the measuring voltages, which are fed to the measuring transducer from the sensor coils arranged further in the casting direction, exhibit higher values. A short term sticking of the still thin casting shell at a specific position within the continuous casting die in deviation from normal operation, is manifested for example by a distinct decline of the measuring voltage in the sensor coil positioned in the area of the location of the disturbance. A further advantage of the method according to the invention is that by comparing the measuring signals of several sensor coils, such casting faults as cracks can be identified before the strand leaves the die and before larger quantities of faulty material are produced.

The invention is explained in greater detail in the following based on the exemplified embodiment depicted in the figures.

Figure 1:
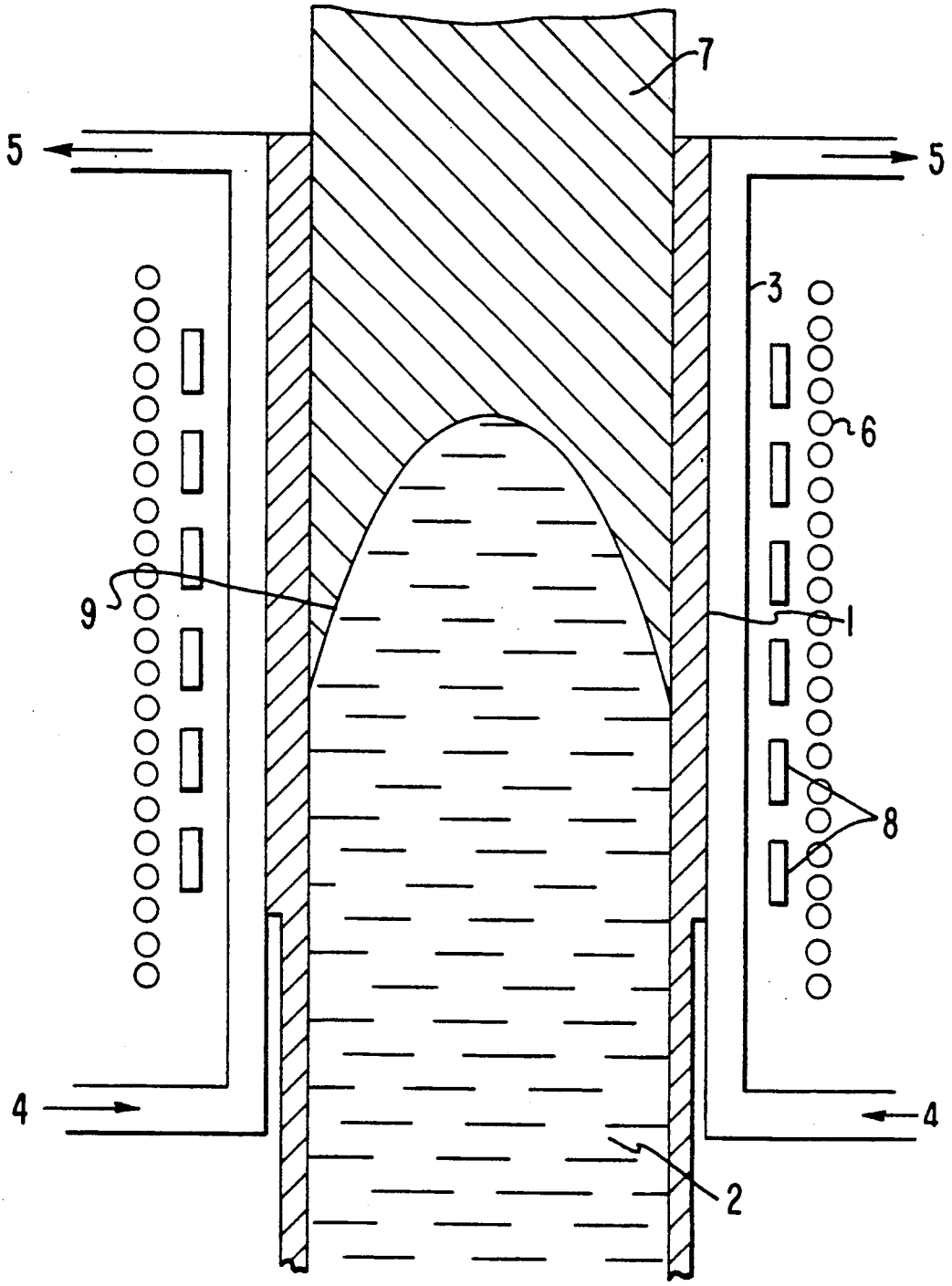
FIG. 1 shows a schematic representation of a die surrounded by a heat exchanger and coils.

In a schematic representation, FIG. 1 depicts a cross section through a tubular continuous casting die 1 arranged in an upright position, which is surrounded in a ring shape by a heat exchanger ring 3 for cooling the liquid metal 2. A coolant is continuously supplied with high flow velocity at the coolant inflow 4, flows through the heat exchanger 3 and, in the upper section of the heat exchanger 3, is drained off again at the coolant outflow 5. The levitation coil 6 is made of winding groups comprising turns of conducting material arranged essentially perpendicular to the axis of the continuous casting die 1 between the coolant inflow 4 and the coolant outflow 5, which are connected to a multiphase voltage source in a conventional manner as is shown in the patent to Lowry (U.S. Pat. No. 4,414,285) which is hereby incorporated by reference. The electromagnetic alternating field of the levitation coil 6 induces currents in the liquid metal 2. These eddy currents cause the metal column 7 and the liquid metal to experience an upwardly directed lifting force. Sensor coils 8 are arranged one above another in the space between the heat exchanger 3 and the levitation coil 6 in a way which allows their clearance from the outer wall of the heat exchanger 3 to be uniform. For example, FIG. 1 depicts six sensor coils 8, whose measuring voltage profile provides information which is altogether sufficient concerning the position and extent of the solidification front 9. For higher demands on the accuracy of the identification of position and extent of the solidification front 9, it is advantageous to provide sensor coils 8 at a distance of at least 1 cm.

The levitation coil 6 and the sensor coils 8 have a concentric arrangement around the cylindrical, continuous casting die 1, whose internal diameter amounts to approximately 20 mm. The sensor coils 8 are arranged inside the levitation coil 6. Each sensor coil is arranged at that level as where the middle turn of each winding group of turns of the levitation coil is arranged, which are excited with the same phase respectively. The levitation coil 6 has a diameter of about 41 . The height of each winding group of turns of the levitation coil is 24 mm in the longitudinal direction. The frequency of excitation is 2,000 Hz. Each of the six sensor coils 8, which are wound from eight turns of a thin, insulated copper wire, has a diameter of about 35 mm.

Now if one supplies the respective signals from the sensor coils to a measuring transducer, the following effective values of the rectified measuring voltage are obtained, when the corresponding signal for air is used as a reference value:

| | |
|---|---|
| Air | 100% |
| Liquid copper melt approx. 1,250° C. | 97.9% |
| Solidified copper approx. 1000° C. | 82.9% |

During the casting process, whereby a strand is continuously produced from pure copper, the effective values in the area near the solidification front 9 are in the range of 86% to 95%.

What is claimed is:

1. A method for monitoring the solidification process during the continuous casting of metals with a continuous casting die of the type that is surrounded by a levitation coil generating an alternating electromagnetic field, comprising the steps of:

introducing molten metal into one end of the die:

energizing the levitation coil so as to induce eddy currents within the metal contained by the die;

providing sensor coils about the die to detect the field produced by the eddy currents within the solidifying metal created by the levitation coil; and evaluating the signals so detected by the sensor coils to monitor the state of the metal within the dies as it solidifies.

2. The method for monitoring the solidification process according to claim 1, wherein the sensor coils are placed inside the levitation coil.

3. The method for monitoring the solidification process according to claim 1, comprising the steps of placing the sensor coils between the continuous casting die and the levitation coil.

4. The method for monitoring the solidification process according to claim 3, comprising the steps of providing a heat exchanger about the die, and arranging the sensor coils in the immediate proximity of the heat exchanger.

5. The method for monitoring the solidification process according to one of the claims 2, 3, 4, or 1, comprising the step of evaluating signals from at least two sensor coils.

6. The method for monitoring the solidification process according to one of the claims 2, 3, 4, or 1, comprising the step of placing the sensor coils so that they have essentially the same clearance from each other in the casting direction.

7. The method for monitoring the solidication process according to claim 5, comprising the step of placing the sensor coils so that they have essentially the same clearance from each other in the casting direction.

8. A device for monitoring the solidification process during continuous casting, comprising:

an elongated continuous casting die;

a levitation coil surrounding said die and constructed so as to induce eddy currents within the metal contained by the die, and sensor coils configured to detect the field produced by said eddy currents induced within the metal by the levitation coil, said sensor coils being concentrically disposed about the continuous casting die and providing signals from which the condition of the solidification process can be deduced.

9. The device of claim 8 wherein the sensor coils are situated inside the levitation coil.

10. The device of claim 8 further comprising a heat exchanger located about the die, and wherein the sensor coils are arranged in the immediate proximity of the heat exchanger.

11. The device of claim 8 wherein the sensor coils have essentially the same clearance from each other in the casting direction.

* * * * *

UNITED STATES PATENT AND TRADEMARK OFFICE

CERTIFICATE OF CORRECTION

PATENT NO. : 5 042 559

DATED : August 27, 1991

INVENTOR(S) : Andreas KRAUSE

It is certified that error appears in the above-identified patent and that said Letters Patent is hereby corrected as shown below:

Column 5, line 2: change "dies" to read --die--;

column 5, line 9: change "steps" to read --step--.

Signed and Sealed this

Twentieth Day of April, 1993

*Attest:*

MICHAEL K. KIRK

*Attesting Officer*

*Acting Commissioner of Patents and Trademarks*